US006315133B1

(12) United States Patent
Franke

(10) Patent No.: US 6,315,133 B1
(45) Date of Patent: Nov. 13, 2001

(54) GOLF CLUB SUPPORT DEVICE

(76) Inventor: James A. Franke, 3270 Adie Rd., Saint Ann, MO (US) 63074

( * ) Notice: Subject to any disclaimer, the term of this patent is extended or adjusted under 35 U.S.C. 154(b) by 0 days.

(21) Appl. No.: 09/591,054

(22) Filed: Jun. 9, 2000

(51) Int. Cl.[7] ..... A63B 55/10
(52) U.S. Cl. ..... 211/70.2; 211/85.7; 211/60.1
(58) Field of Search ..... 211/70.2, 85.7, 211/60.1, 72; 473/282; 248/512, 156, 530, 520

(56) References Cited

U.S. PATENT DOCUMENTS

D. 279,309 * 6/1985 Rosen et al. ..... D21/793
D. 364,439 * 11/1995 Ragusin ..... D21/796
D. 377,511 * 1/1997 Glennon ..... D21/796
D. 410,518 * 6/1999 Didier et al. ..... D21/789
2,595,987 * 5/1952 Shears ..... 206/315.2
4,063,731 * 12/1977 Kitay ..... 473/286
4,616,749 * 10/1986 Briggs ..... 206/315.2
5,230,507 * 7/1993 White et al. ..... 473/282
5,704,847 * 1/1998 Glennon ..... 473/282

* cited by examiner

*Primary Examiner*—Gregory J. Strimbu

(57) ABSTRACT

A golf club support device for supporting the grips of golf clubs above the ground. The golf club support device includes an elongate support member having a top edge, a bottom edge, and end edges, and also having a plurality of slots spaced apart and extending in the top edge thereof and each slot being adapted to removably receive a portion of a shaft of a golf club; and also includes one or more ground penetrating members securely disposed in the bottom edge of the elongate support member and extending outwardly therefrom; and further includes a golf bag mounting member securely attached to the elongate support member for removably mounting the elongate support member to a golf bag.

1 Claim, 2 Drawing Sheets

GOLF CLUB SUPPORT DEVICE

BACKGROUND OF THE INVENTION

1. Field of the Invention

The present invention relates to a club rest support and more particularly pertains to a new golf club support device for supporting the grips of golf clubs above the ground.

2. Description of the Prior Art

The use of a club rest support is known in the prior art. More specifically, a club rest support heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,483,996; U.S. Pat. No. 4,834,444; U.S. Pat. No. 2,737,990; U.S. Pat. No. 4,616,749; U.S. Pat. No. 3,058,504; and U.S. Pat. No. Des. 164,503.

While these devices fulfill their respective, particular objectives and requirements, the aforementioned patents do not disclose a new golf club support device. The inventive device includes an elongate support member having a top edge, a bottom edge, and end edges, and also having a plurality of slots spaced apart and extending in the top edge thereof and each slot being adapted to removably receive a portion of a shaft of a golf club; and also includes one or more ground penetrating members securely disposed in the bottom edge of the elongate support member and extending outwardly therefrom; and further includes a golf bag mounting member securely attached to the elongate support member for removably mounting the elongate support member to a golf bag.

In these respects, the golf club support device according to the present invention substantially departs from the conventional concepts and designs of the prior art, and in so doing provides an apparatus primarily developed for the purpose of supporting the grips of golf clubs above the ground.

SUMMARY OF THE INVENTION

In view of the foregoing disadvantages inherent in the known types of club rest support now present in the prior art, the present invention provides a new golf club support device construction wherein the same can be utilized for supporting the grips of golf clubs above the ground.

The general purpose of the present invention, which will be described subsequently in greater detail, is to provide a new golf club support device which has many of the advantages of the club rest support mentioned heretofore and many novel features that result in a new golf club support device which is not anticipated, rendered obvious, suggested, or even implied by any of the prior art club rest support, either alone or in any combination thereof.

To attain this, the present invention generally comprises an elongate support member having a top edge, a bottom edge, and end edges, and also having a plurality of slots spaced apart and extending in the top edge thereof and each slot being adapted to removably receive a portion of a shaft of a golf club; and also includes one or more ground penetrating members securely disposed in the bottom edge of the elongate support member and extending outwardly therefrom; and further includes a golf bag mounting member securely attached to the elongate support member for removably mounting the elongate support member to a golf bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf club support device which has many of the advantages of the club rest support mentioned heretofore and many novel features that result in a new golf club support device which is not anticipated, rendered obvious, suggested, or even implied by any of the prior art club rest support, either alone or in any combination thereof.

It is another object of the present invention to provide a new golf club support device which may be easily and efficiently manufactured and marketed.

It is a further object of the present invention to provide a new golf club support device which is of a durable and reliable construction.

An even further object of the present invention is to provide a new golf club support device which is susceptible of a low cost of manufacture with regard to both materials and labor, and which accordingly is then susceptible of low prices of sale to the consuming public, thereby making such golf club support device economically available to the buying public.

Still yet another object of the present invention is to provide a new golf club support device which provides in the apparatuses and methods of the prior art some of the advantages thereof, while simultaneously overcoming some of the disadvantages normally associated therewith.

Still another object of the present invention is to provide a new golf club support device for supporting the grips of golf clubs above the ground.

Yet another object of the present invention is to provide a new golf club support device which includes an elongate support member having a top edge, a bottom edge, and end edges, and also having a plurality of slots spaced apart and extending in the top edge thereof and each slot being adapted to removably receive a portion of a shaft of a golf club; and also includes one or more ground penetrating members securely disposed in the bottom edge of the elongate support member and extending outwardly therefrom; and further includes a golf bag mounting member securely attached to the elongate support member for removably mounting the elongate support member to a golf bag.

Still yet another object of the present invention is to provide a new golf club support device that keeps the grips of the golf clubs dry since they aren't placed directly upon the ground.

Even still another object of the present invention is to provide a new golf club support device that protects the golf clubs from damage and wear.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
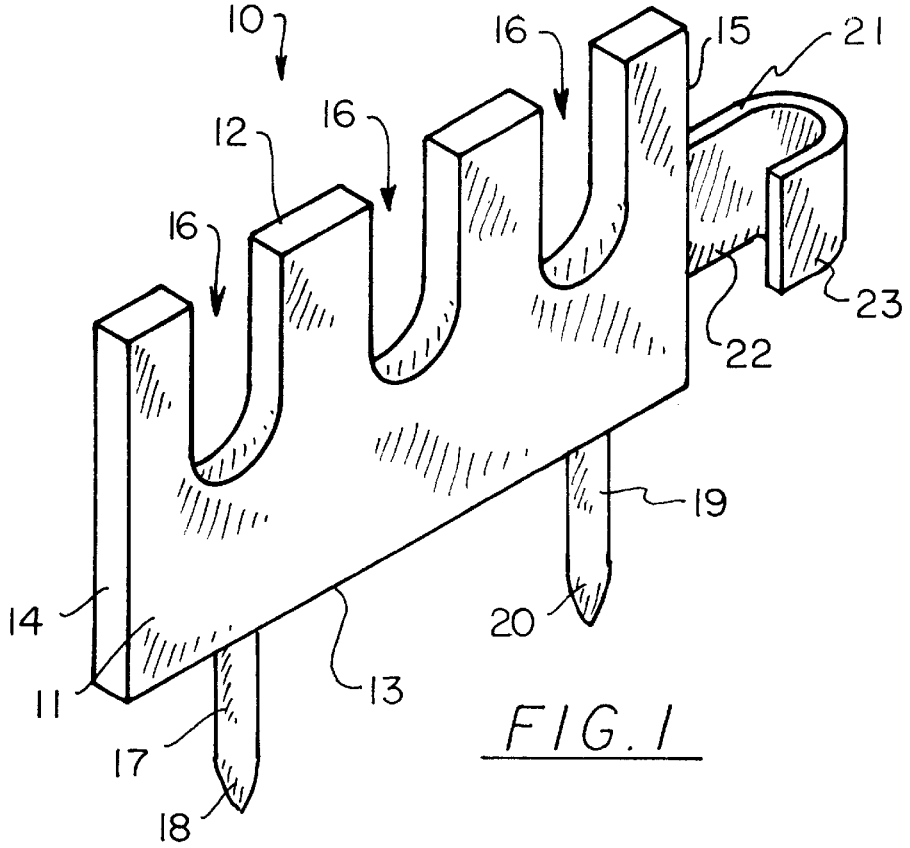
FIG. 1 is a perspective view of a new golf club support device according to the present invention.
Figure 2:
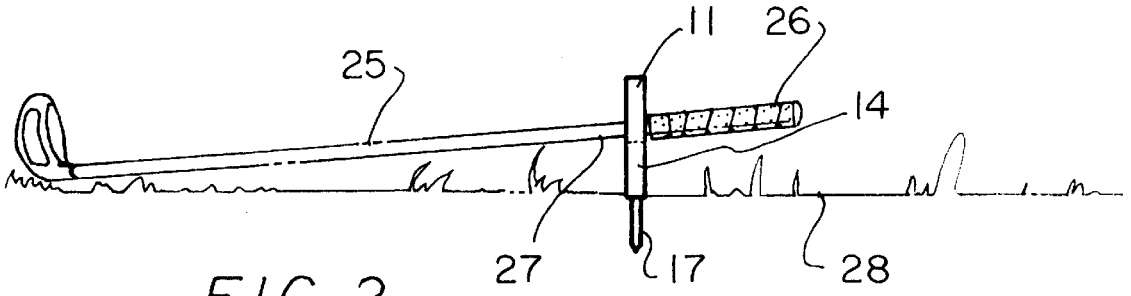
FIG. 2 is an end elevational view of the present invention shown in use.
Figure 3:
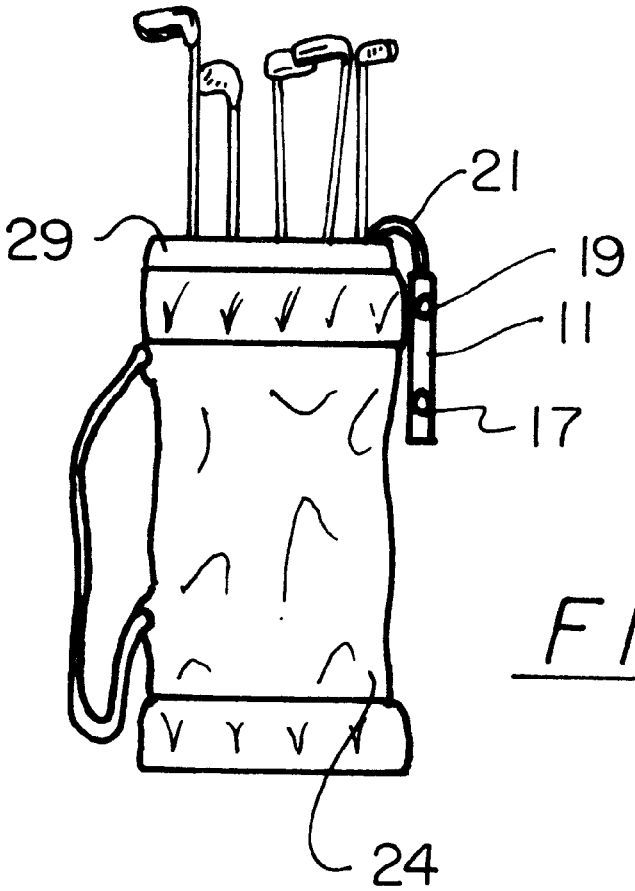
FIG. 3 is a side elevational view of the present invention mounted to a golf bag.

With reference now to the drawings, and in particular to FIGS. 1 through 3 thereof, a new golf club support device embodying the principles and concepts of the present invention and generally designated by the reference numeral 10 will be described.

As best illustrated in FIGS. 1 through 3, the golf club support device 10 generally comprises an elongate support member 11 having a top edge 12, a bottom edge 13, and end edges 14,15, and also having a plurality of slots 16 preferably three, spaced apart and extending in the top edge 12 thereof and each slot 16 being adapted to removably receive a portion of a shaft 27 of a golf club 25. Each of the slots has a bottom portion, and a first distance extends between the bottom portion of each of the slots and the bottom edge of the elongate support member. The elongate support member 11 is generally planar and has a length of approximately 7¼ inches, a width of approximately 5¼ inches, and a thickness of approximately 2½ inches.

A pair of ground penetrating members 17,19 are securely and conventionally disposed in the bottom edge 13 of the elongate support member 11 and extend outwardly therefrom. A first one of the ground penetrating members is positioned directly below a first end slot of the slots and a second one of the ground penetrating members is positioned directly below a second end slot of the slots. Each ground penetrating member 17,19 is a spike having a tapered bottom end 18,20 for easily penetrating a ground 28. Each of the ground penetrating members extends a second distance from the bottom edge of the elongate support member to an end of the ground penetrating member. The first and second distances are approximately equal to each other such that the end of the bottom portions of each of the slots and the end of the ground penetrating member is equidistant from the bottom edge of the elongate support member.

A golf bag mounting member 21 is securely and conventionally attached and welded to the elongate support member 11 for removably mounting the elongate support member to a golf bag 24. The golf bag mounting member 21 is securely attached to one of the end edges 15 of the elongate support member 11 and extends outwardly therefrom. The golf bag mounting member 21 has a main portion 22 which is securely and conventionally attached and welded to the elongate support member 11 and has an end portion 23 which includes a flat portion extending generally parallel to the main portion 22 and a bent portion connecting the flat portion to the main portion. The golf bag mounting member 21 is essentially a hook having the end portion 23 being spaced from and curved upon the main portion 22 to facilitate hooking over a top edge 29 of the golf bag 24 with the golf bag mounting member 21 being removably suspended from the golf bag 24.

In use, the user can conveniently carry the golf club support device 10 along by hooking the golf bag mounting member 21 over a top edge 29 of the golf bag 24 with the elongate support member 11 essentially being suspended from the golf bag 24. To use the golf club support device 10, the user urges the spikes 17,19 into the ground 28 and places the shaft portions 27 of the golf clubs 25 being used in the slots 16 of the elongate support member 11 with the handles or grips 26 being kept off the ground 28 especially if the ground 28 is wet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club support device comprising:

an elongate support member having a top edge, a bottom edge, and end edges, and also having three slots formed therein, said slots being spaced apart and extending in said top edge and each slot being adapted to removably receive a portion of a shaft of a golf club, said elongate support member having a length of approximately 7¼ inches, a width of approximately 5¼ inches, and a thickness of approximately 2½ inches;

two ground penetrating members securely disposed in said bottom edge of said elongate support member and extending outwardly therefrom, each said ground penetrating member being a spike having a tapered bottom end for penetrating a ground; and a golf bag mounting member securely attached to said elongate support member for removably mounting said elongate support member to a golf bag, said golf bag mounting member being securely attached to one of said end edges of said elongate support member and extending outwardly therefrom, said golf bag mounting member having a main portion securely attached to said elongate support member and having an end portion which includes a flat portion extending generally parallel to said main portion and a bent portion connecting said flat portion to said main portion, said golf bag mounting member comprising a hook adapted to hook over a top edge of the golf bag with said golf bag mounting member being removably suspended from the golf bag;

each slot having a bottom portion, said bottom portion of each of said slots is spaced from said bottom edge of said elongate support member by a first distance;

said bottom end of each of said spikes being spaced a second distance from said bottom edge of said elongate support member; and said first and second distances being approximately equal to each other;

wherein a first one of said ground penetrating members is positioned directly below a first end slot of said three of slots and a second one of said ground penetrating members is positioned directly below a second end slot of said three of slots.

* * * * *